US005628667A

United States Patent [19]

Levi

[11] Patent Number: 5,628,667

[45] Date of Patent: May 13, 1997

[54] SINUOUS TOY

[76] Inventor: Shimon Levi, 6542 Tony Ave., West Hills, Calif. 91307

[21] Appl. No.: 606,926

[22] Filed: Feb. 26, 1996

[51] Int. Cl.[6] ..... A63H 11/12

[52] U.S. Cl. ..... 446/278; 446/368

[58] Field of Search ..... 446/278, 368, 446/490, 156, 158

[56] References Cited

U.S. PATENT DOCUMENTS

| | | | |
|---|---|---|---|
| 1,049,345 | 1/1913 | Dolman | 446/368 X |
| 1,745,232 | 1/1930 | Richter | 446/368 |
| 2,035,308 | 3/1936 | Ferber | 446/278 X |
| 2,194,537 | 8/1940 | Adams | 446/368 X |

FOREIGN PATENT DOCUMENTS

| | | | |
|---|---|---|---|
| 666033 | 10/1938 | Germany | 446/368 |

*Primary Examiner*—Mickey Yu

*Attorney, Agent, or Firm*—Allan M. Shapiro

[57] ABSTRACT

In its preferred embodiment, the sinuous toy is a mechanical snake with a plurality of body elements. The body elements are each pivoted with respect to each adjacent body element on a vertical axis. Each body element has a large circular opening therethrough. The body elements are configured to be more narrow laterally away from the pivot axis so that the body elements can swing with respect to each other to represent sinuous snake motion. A helical actuator coil extends through the interior opening of the plurality of body elements. The outside swept diameter of the helical coil actuator is slightly larger than the interior openings through the body elements so that the body elements rise and fall in a direction generally parallel to the pivot axes between the body elements. Means is provided to supply tension between the head and tail of the sinuous toy so that the body elements are thrust sideways to have twice as much sideways motion as the interior diameter of the body elements. Rotating the helical coil actuator through the body elements causes progressive sinuous motion both laterally and vertically to cause sideward progression of the sinuous toy.

17 Claims, 3 Drawing Sheets

FIG. 9
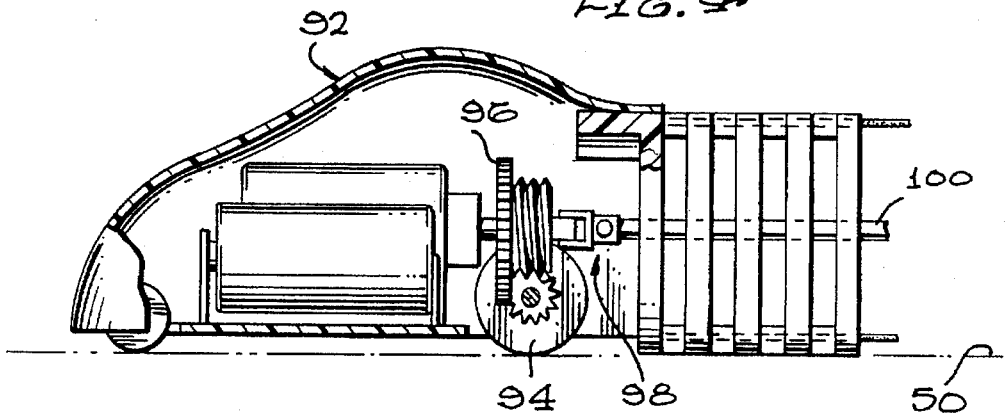
FIG. 5
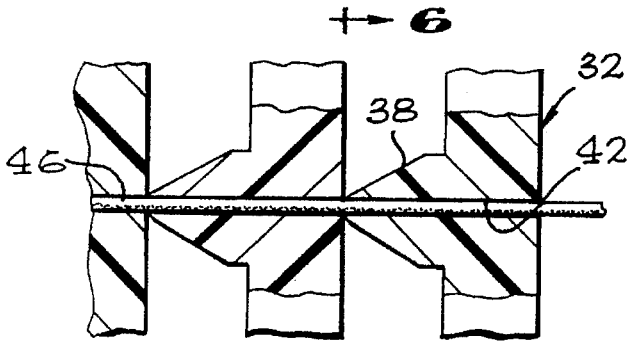
FIG. 12
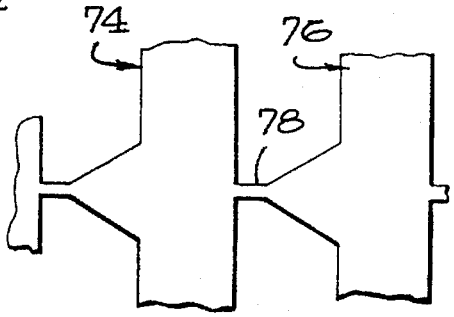
FIG. 6
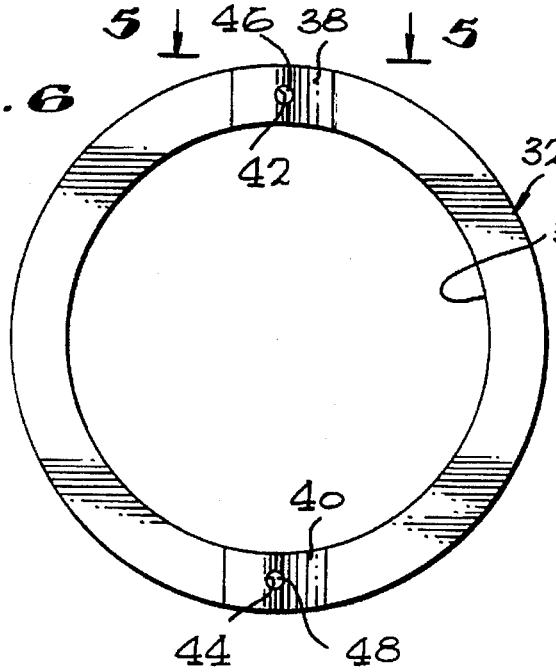
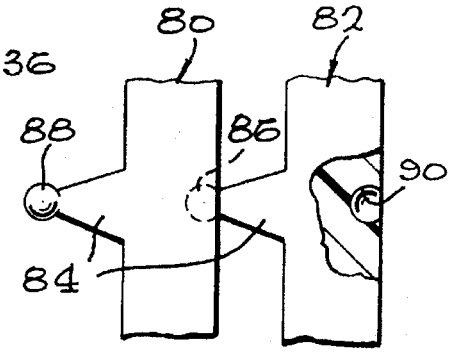
FIG. 13

SINUOUS TOY

FIELD OF THE INVENTION

This invention is directed to a sinuous toy, and particularly a toy in the configuration of a snake, where the rotation of a helix in the sinuous toy causes both lateral and up-and-down sinuous motion to provide sidewards motion of the toy.

BACKGROUND OF THE INVENTION

The sinuous toy of this invention represents a snake or other animal which requires similar animated motion, either in its body or in one of its extremities. Toys should be as realistic as possible in both configuration and motion. In addition, toys should be easy to construct so that they can be provided to the public at a reasonable price. Furthermore, toys should be sufficiently sturdy so that they can withstand the play activities of children and youth who might not be gentle in managing the toy.

No toy exists which provides the sinuous motion of a snake, and particularly a sidewinder snake.

SUMMARY OF THE INVENTION

In order to understand this invention, it can be stated in essentially summary form that it is directed to a toy which is configured to have sinuous motion, particularly to represent a snake. The sinuous toy has a plurality of body elements, each serially positioned and pivoted with respect to each other on axes which may be generally upright with respect to the snake. The body elements are longer at the pivots than at the edges so that they can pivot with respect to adjacent body elements to form the sinuous configuration. Each body element has an opening therethrough and a helical coil actuator is positioned in the opening. The helical coil actuator has a swept diameter which is slightly larger than the opening in the body element at that longitudinal position so that, in addition to lateral motion, the individual elements are moved up and down by the helical coil actuator. Tension between the ends of the body force the body elements into sinuous position, which is more than twice the throw of the helix at that body element. The body elements preferably become smaller toward the tail of the snake for realistic configuration, and the helix has a smaller throw when the body element is smaller. A motor rotates the helix with respect to the body elements.

It is, thus, a purpose and advantage of this invention to provide a sinuous toy which moves to represent the motion of a snake and particularly a sidewinder type of rattlesnake.

It is another purpose and advantage of this invention to provide a sinuous toy which is easy to construct so that it can be economically manufactured and sold to a wide customer base.

It is a further purpose and advantage of this invention to provide a sinuous toy which is sturdy so that it can provide entertainment even when treated roughly.

It is a further purpose and advantage of this invention to provide a sinuous toy which has realistic snake motion so that it can be instructive to the user.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 4 is an enlarged section through an alternative embodiment of the front of the snake, shown on the same scale as FIG. 3.

FIG. 5 is an enlarged plan view, with parts broken away and parts taken in section, of a first preferred embodiment of the body elements of the sinuous toy of this invention, as seen generally along the line 5—5 of FIG. 6.

FIG. 6 is a section through the entire body, showing a body element as seen generally along line 6—6 of FIG. 5.

FIG. 12 is a plan view of a fourth preferred embodiment of a suitable series of body elements which, in this case, are formed together with a living hinge attachment therebetween.

FIG. 13 is a plan view, with parts broken away and parts taken in section, of a fifth preferred embodiment of body elements suitable for the sinuous toy of this invention.

DESCRIPTION OF THE PREFERRED EMBODIMENTS

Figure 1:
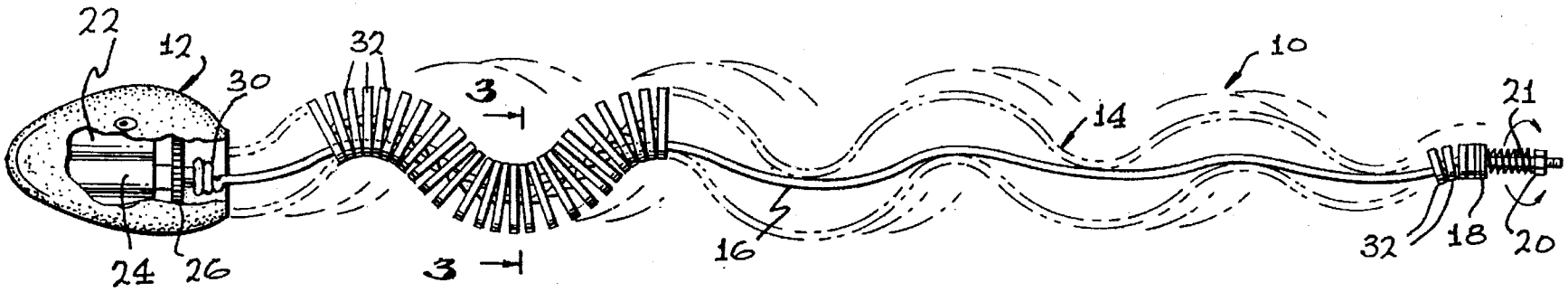
FIG. 1 is a plan view of the sinuous toy of this invention, with the skin removed, parts broken away, parts shown symbolically., and parts shown in alternate positions in dot-dash lines.
Figure 2:
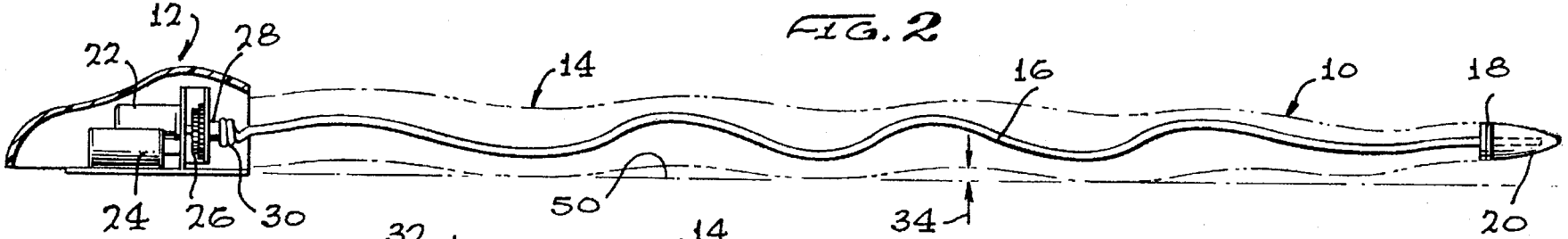
FIG. 2 is a side-elevational view thereof, with the skin and body elements broken away, but the skin position shown in dot-dash lines.
Figure 3:
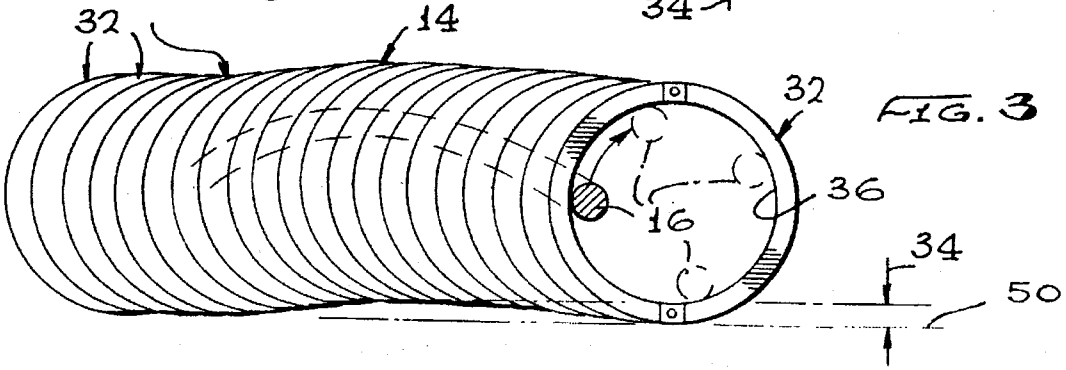
FIG. 3 is an enlarged section taken generally along line 3—3 of FIG. 1.

A preferred embodiment of the sinuous toy of this invention is a snake 10, as generally indicated in FIGS. 1, 2 and 3. Other elongated toys Which would benefit from sinuous motion can also employ this invention, but the snake is a preferred embodiment. The snake 10 is principally comprised of a head 12 and a body 14. Internally of the body 14 is helical actuator 16. The helical actuator extends the length of the body and is rotatable internally of the body. There may be tension in the helical actuator to offer compressive stresses to the body and, to accomplish this, thrust washers 18, which bear against the tail end of the body, are engaged by nut 20, which is mounted on the threaded tail end of the helical actuator. If desired, the illustrated compression spring 21 may be placed therebetween, but is not necessary.

The head 12 is a hollow rigid structure in which is mounted a DC motor 22, which is energized by DC battery 24. The motor drives reduction gearing 26. The reduction gearing has output shaft 28, which rotates one revolution for every desired sinuous cycle. The output shaft thus rotates about one revolution per second, or slower. The helical actuator 16 has a tightly coiled spring 30 at its head end which is connected to the output shaft 28. Thus, there is some flexibility in the coupling between the output shaft and the helical actuator so that the helical actuator remains centrally aligned with the output shaft.

The body 14 is made up of a plurality of body elements. Each of the body elements should be the same, except perhaps for diameter, but different configurations of body elements are possible. FIGS. 3, 4, 5 and 6 illustrate a first preferred embodiment of suitable body elements. Body element 32 is shown in FIGS. 3, 5 and 6 and is illustrative of the species of body element. Throughout a substantial part of the length, the body elements are the same size. For example, as seen in FIG. 2, the body elements are the same size from the head 12 back to about the dimension arrow 34. From the dimension arrow 34 back to the tail, the body elements may be progressively smaller, as is described below. The body element 32 is a ring with circular cylindrical interior and outside surfaces. The ring has a rectangular cross section and is uniform around the ring except for the pivot extensions. The interior surface 36 is a tubular cylindrical surface. As seen in FIG. 5, the rings of the body elements are spaced from each other. This is accomplished by a pair of pivot wedges integrally molded on each of the body elements. Pivot wedges 38 and 40 are shown in FIG. 6. As seen in FIG. 5, the pivot wedge 38 extends away from the ring at least as much as the ring thickness.

In order to pull the body elements together, flexible connectors are provided. Holes 42 and 44 extend through the rings and through the pivot wedges. The holes are positioned at a radial position about halfway between the inner and outer surfaces of the body element, as seen in FIG. 6. The holes extend through the pivot wedges at the point where each pivot wedge contacts the adjacent body element. Flexible connectors 46 and 48 are threaded through these holes. When the plurality of body elements is assembled and with the flexible connectors therethrough, the flexible connectors are pulled into modest tension so that the body elements continue to lie close to each other. The flexible connectors are in the form of flexible members which are strong in tension, such as threads, cords, multi-filament or monofilament threads, lines or strings. This structure permits the body assembled from this plurality of body elements to move in a sinuous direction.

In view of the fact that the two pivot wedges are in line, the adjacent body elements pivot with respect to each other substantially on an axis which lies through both contact points of the pivot wedges on a particular body element. In the snake, these axes are preferably at a normal direction to the surface 50 on which the snake lies. The plurality of body elements make up the body of the snake. The body is thus flexible in the lateral direction, as shown in FIG. 1. It has a small amount of upright flexibility, as seen in FIG. 2. The body elements are covered with a suitable flexible skin which follows the body element contours in order to simulate the snake motions of the sinuous toy.

The helical actuator 16 is very critical to the proper motion of the sinuous toy. The helical actuator 16 is substantially in the form of a helix and is made of fairly hard, substantially springy, substantially non-malleable steel wire bent into the appropriate shape. For purposes of definition, when the helix is rotated about its axis, the outermost diameter reached by the helix at any one plane perpendicular to the axis is the helix diameter. This helix diameter is substantially constant along that portion of the length of the body that the body elements have the same inside diameter. The helix diameter is slightly larger than the inside diameter of the body element at that position along the length of the body. As stated earlier, the forward portion of the body is preferably of substantially constant diameter, and thus the swept diameter of the helix is also the constant for that forward portion of the body. The swept diameter of the helix is slightly larger than the inside diameter of the body elements. The preferred helix diameter is about 10 percent larger than the inside diameter of the body elements at that location along the length. The dimension arrow 34 shown in FIGS. 2 and 3 shows that, since the helix is larger than the inside diameter, when the helix is up, it lifts those body elements which are at the highest portion of the helix so that the body is raised in that location above the support surface 50. This is illustrated in FIGS. 2 and 3 by the fact that a group of the body elements at the highest point of the helix is raised above the surface 50.

In top view, it is seen that the same helical configuration of the helical actuator drives the body laterally away from the helical center line. Since the body elements can pivot with respect to each other on the pivot wedges of the body elements and since the tension in the helical actuator longitudinally compresses the body elements, they must take the sinuous form illustrated in FIG. 1. The sinuous side-to-side motion of the body elements is more than twice the interior diameter of the body elements. The limit of rotation of the body elements with respect to each other is the contact of the edges of the body elements together at the closed side, so there is a definite limit as to the angular rotation of one body element with respect to the other. The limit is this contact of the edges of the body elements. This is shown in FIG. 1 at the upper edge of the 3—3 section line, i.e., where the adjacent body elements form a concave curve. The longitudinal flexible connectors 46 and 48 hold the body elements together into the proper configuration, while permitting them to rotate with respect to each other to this limited extent on the axis defined by those pivot wedges. Since the over-all length of the sinuous shape is shorter than if the body elements were permitted to line up in a straight shape, the tension of the helical actuator maintains the maximum sinuous configuration.

It must also be noted that this sinuosity proceeds down the length of the snake as the helix turns. At the same time that this sinuosity moves from side to side of the general longitudinal line of the snake, sections of the body elements are raised by the helical actuator. Thus, the snake moves sideways. Where the snake body is lifted off of the surface 50, the body is moving laterally in one direction and, where the body of the snake is downward against the surface 50, the body is moving in the opposite direction. This provides lateral propulsion.

For the sake of simulation of snake body shape, the tail of the snake should be tapered downwardly (see FIGS. 1 and 2). This is accomplished by using successive body elements of slightly smaller inside and outside diameter. These body elements each have appropriate pivot wedges and flexible connectors tying the whole structure together. As the interior diameter gets smaller rearwardly along the length of the snake, the helix also has a lesser swing diameter. In each case, the swing diameter is slightly larger than the interior opening of the body element at that position along the length of the body. By this construction, the tail can also move sinuously along with the main body of the snake toy.

The necessary elements to the body to provide for the sinuosity comprise the body elements pivotal with respect to each other and, in a substantially circular interior opening in each of the body elements, constraint of the body elements with respect to each other to permit them to pivot with respect to each other on substantially parallel axes (in the case of a simulated snake) and a helical actuator which has a swing diameter slightly larger than the interior opening of the body element at that position along the length of the snake. With these concepts in mind, it is clear that other body element configurations are feasible.

Figure 7:
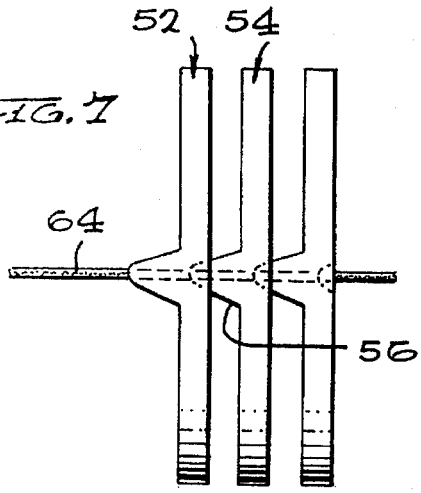
FIG. 7 is a plan view of a second preferred embodiment of body elements suitable for the sinuous toy of this invention.
Figure 8:
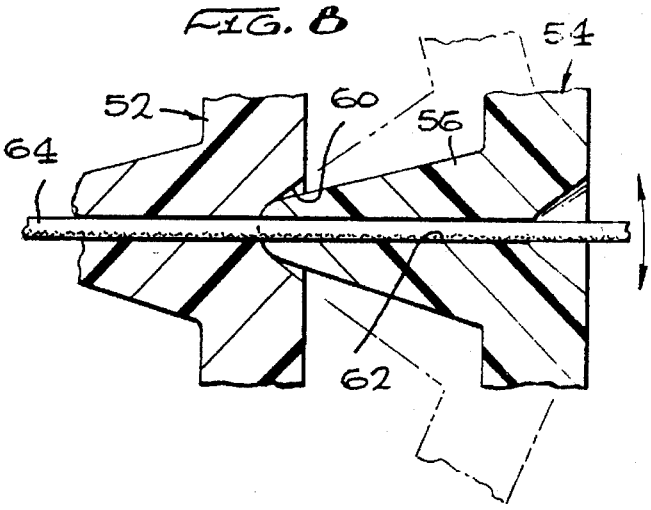
FIG. 8 is an enlarged plan view of FIG. 7, with parts broken away and parts taken in section.
Figure 9:
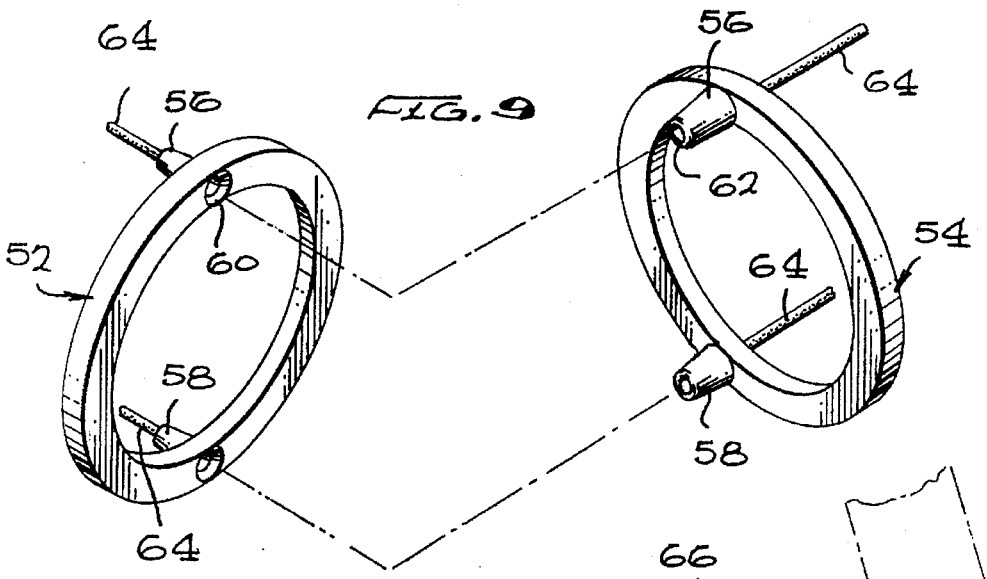
FIG. 9 is an isometric exploded view of two of the body elements shown in FIG. 8.

For example, in FIGS. 7, 8 and 9, the body elements 52 and 54 are identical and lie adjacent each other along the length of the body. The body elements each have a pair of conical posts, with posts 56 and 58 specifically identified in body element 54. As best seen in FIG. 8, the post 56 enters in a shallow conical recess 60. The conical recess 60 has a larger total included angle than the total included angle of the conical posts such as post 56. This permits the body element 54 to swing to the dashed lines in FIG. 8 positioned with respect to the body element 52. This swing is sufficient to allow the outer edges of the body elements to come in contact, which is the ultimate limit of swinging of the one body element with respect to the other. Since there are two such conical posts for each body element, the pivoting of one body element with respect to the next is generally along an axis through the tips of those posts.

In addition, the posts have holes therethrough. Hole 62 through post 56 is identified in FIG. 8. Flexible connector 64 extends through the successive holes in successive body elements so that the body elements are constrained with respect to each other. They can rotate with respect to each other around the axis defined by the posts in their conical recesses, and the structure is loose enough to permit a slight motion up and down with respect to the supporting surface. However, most of the motion of the body elements with respect to each other is in a lateral direction transverse to the pivot axis of the body elements with respect to each other. As is seen in FIG. 9, each of the body elements has two such conical recesses and two holes, and there are two flexible connectors extending down the length of the body elements lying adjacent each other.

Figure 10:
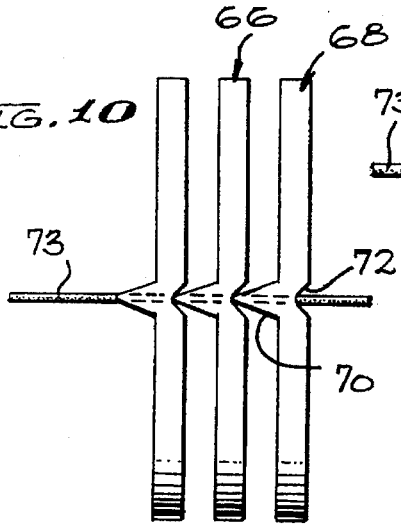
FIG. 10 is a plan view of a third preferred embodiment of suitable body elements for the sinuous toy of this invention.
Figure 11:
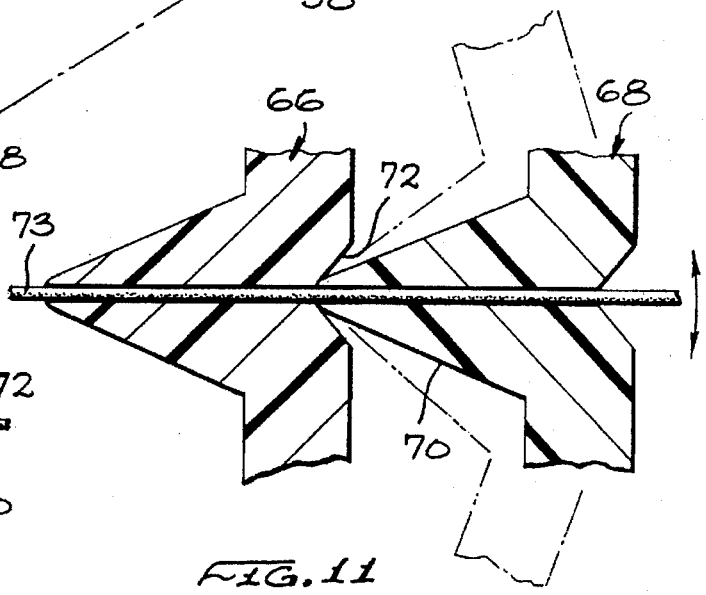
FIG. 11 is a downwardly looking section through two of the body elements of FIG. 10, taken on the line of the tension member which runs therethrough.

While FIGS. 7, 8 and 9 illustrate body elements which have posts which are rounded on their nose, the body elements in the species shown in FIGS. 10 and 11 are more pointed so as to swing with respect to each other more on a knife edge rather than on a spherical surface. Body elements 66 and 68 are identical to each other and are similar to the body elements 52 and 54. There are two posts on each of the body elements, with only the upper post being shown in FIGS. 10 and 11. Post 70 engages in recess 72. As described above, the recess has larger total included angle than the post to permit swinging of one body element with respect to the other until the edges touch. The post 70 may be either conical or wedge-shaped. A pair of holes goes through each of the body elements in the manner seen in FIG. 9, and a pair of flexible connectors extends through the holes. Flexible connector 73 is identified in FIGS. 10 and 11.

FIG. 12 illustrates adjacent body elements 74 and 76. These adjacent body elements are molded together, rather than having posts and flexible elements to provide the spacing, the flexibility and the attachment. Body elements 74 and 76 are two of a series of such body elements. They are connected together by webs at the top and bottom. The web 78 is shown in FIG. 12 as connecting the two body elements. The web 78 is strengthened at its one side, and the thin part of the web serves as a self-hinge. The limitation of swinging of one body element with respect to the next is the same as previously, with the edges of the body elements touching each other at maximum curvature. Since they are molded together, no separate flexible connector is necessary, but is inherent in the construction.

FIG. 13 shows another version of the manner in which the body elements can be attached. Body elements 80 and 82 are shown. Body element 82 has a post 84 thereon. The post has a ball 86 which snaps into a socket in body element 80. A similar ball is shown at 88, and a similar socket is shown at 90. Each of the body elements is the same and is molded of material which is sufficiently flexible to permit the ball to be snapped into the socket and remain there during pivoting. As with the previous body elements, there are two such ball and socket attachments so that each body element rotates with respect to an adjacent body element on an axis which passes through both of the balls on the same body element. In order to have the sinuosity occur in the correct direction, these axes through the pairs of balls are generally upright with respect to the supporting surface.

The moving sinuosity of the sinuous toy, coupled with the slight raising of certain sections of the snake body in conjunction with its sinuosity, provides sideways motion of the snake. In order to provide a forward component of motion at the same time, as seen in FIG. 4, a version of the snake 92 can be provided with a forward propulsion drive wheel 94, which is powered from the reduction drive gearing 96. This drive wheel is not necessary for snake propulsion, but provides additional mobility in cases where such is desired. Furthermore, the wheel 94 can be coupled to the gearing 96 at an angle by use of an appropriate gear, so that the wheel 94 can move in a direction sideways or some other angle with respect to the head orientation. Also, a U-joint, indicated generally at 98, can be used to flexibly couple the drive gearing 96 to the helical actuator 100.

This invention has been described in its presently preferred best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A sinuous toy comprising:

a plurality of body elements arranged together in a generally longitudinal orientation, each said body element being substantially configured as a ring having a substantially circular interior opening and a substantially circular external surface, each of said body elements having two posts thereon, said posts being configured to engage against the adjacent body element, said posts being substantially diametrically opposite each other on said body element and said posts defining an axis of rotation of said body element with respect to said adjacent body element, said axis of rotation extending generally upright with respect to a surface on which the sinuous toy is resting so that sinuosity is substantially limited to a lateral direction with respect to said axis and with respect to the longitudinal direction of said sinuous toy; and a helical actuator positioned generally longitudinally of said sinuous toy and extending through said openings in said body elements, said helical actuator being rotatable in said body elements and having a helical diameter at least as large as the opening in each said body element at that body element position along the length of said sinuous toy.

2. The sinuous toy of claim 1 wherein at any point along its length said helical actuator has a diameter larger than the diameter of said opening in said body element located at that point.

3. The sinuous toy of claim 2 wherein said helical actuator has a diameter substantially 1.1 times the diameter of the opening in said body element, so as to lift said body element when said helical actuator is in the raised position.

4. The sinuous toy of claim 3 wherein said helical actuator engages both ends of said plurality of body elements so as to compress said body elements to a sinuous configuration laterally of said toy, said sinuous configuration being limited by the size of said openings in said body elements and by the helical diameter of said helical actuator.

5. The sinuous toy of claim 1 further including a tension member extending through said body elements to hold said body elements interiorly adjacent each other.

6. The sinuous toy of claim 5 wherein said tension element is a flexible connector.

7. The sinuous toy of claim 1 wherein a tension coil extends through said plurality of body elements and through said posts so that said body elements are permitted to pivotally rotate with respect to each other about said axis but are limited in separation from each other.

8. The sinuous toy of claim 7 wherein said adjacent body elements of said sinuous toy are limited in rotation with respect to each other by touching of the outer edges of said body elements upon reaching the rotational limit.

9. The sinuous toy of claim 1 wherein said posts on each said body element rest in corresponding recesses in the adjacent body element.

10. The sinuous toy of claim 9 wherein each said post has a ball thereon and said recess is a ball recess which resiliently retains said ball.

11. A sinuous toy comprising:

a plurality of body elements, each of said plurality of body elements having an opening therethrough, said openings in said body elements being substantially circular, each of said body elements having pivot means thereon for engaging its adjacent body elements so as to provide for pivotal mounting in each body element with respect to its adjacent body elements, said pivot means comprising first and second posts spaced from each other across said body elements and defining a pivot axis between adjacent body elements;

two flexible connectors, one passing through each of said posts so as to attach said body elements together so that they can flex with respect to each other around the point of post contact with the adjacent body element; and a helical actuator extending through said plurality of body elements through said openings therethrough, said helical actuator being curved in a substantially helical configuration and having an outer diameter sufficient to cause sinuous motion of said plurality of body elements in a direction lateral to the general lengthwise direction of said helical actuator.

12. The sinuous toy of claim 11 wherein said helical actuator has a diameter slightly larger than the interior diameter of said body elements.

13. The sinuous toy of claim 11 wherein said helical actuator has a diameter which is about 10 percent larger than the diameter of said opening through said body elements.

14. The sinuous toy of claim 11 wherein the size of the interior opening through said body elements along the length of said sinuous toy is smaller than the size of said helical actuator at each position along the length of said sinuous toy.

15. The sinuous toy of claim 11 wherein said body elements are limited in angular rotation with respect to each other about said axis by contact of said adjacent body elements with each other.

16. The sinuous toy of claim 11 wherein said sinuous toy has a head adjacent said plurality of body elements, said head having a motor therein, said motor being connected to rotate said helical actuator so as to cause sinuous motion of said toy.

17. The sinuous toy of claim 11 wherein said helical actuator is connected to an adjacent body element adjacent each end of said helical actuator so as to cause compression in said plurality of body elements so that sinuosity of said body elements substantially equals three times the interior diameter of said body elements.

* * * * *